US006077102A

United States Patent [19]

Borzi et al.

[11] Patent Number: 6,077,102

[45] Date of Patent: Jun. 20, 2000

[54] TOP DOWN ELECTRICAL DISTRIBUTION CENTER ASSEMBLY

[75] Inventors: James William Borzi, Laredo, Tex.; Joseph Matthew Senk, Cortland, Ohio; Kevin Paul Phillips, Chagrin Falls, Ohio; Randall Kent Smith, Fowler, Ohio; Frederick Edward Mlakar, Hermitage, Pa.; Sharon Elizabeth Wingert Arkwright, Vienna, Ohio

[73] Assignee: General Motors Corporation, Detroit, Mich.

[21] Appl. No.: 09/069,902

[22] Filed: Apr. 30, 1998

Related U.S. Application Data

[63] Continuation-in-part of application No. 08/871,038, Jun. 9, 1997, Pat. No. 5,788,529.

[51] Int. Cl.[7] ..... H01R 13/627

[52] U.S. Cl. ..... 439/364; 439/76.2

[58] Field of Search ..... 439/34, 76.2, 248, 439/362, 364, 402–405; 361/622, 624, 728, 730; 29/829, 830, 831, 842

[56] References Cited

U.S. PATENT DOCUMENTS

| | | | |
|---|---|---|---|
| 5,023,752 | 6/1991 | Detter et al. | 439/76.2 |
| 5,207,587 | 5/1993 | Hamill et al. | 439/76.2 |
| 5,651,683 | 7/1997 | Shimamura et al. | 439/34 |
| 5,715,135 | 2/1998 | Brussalis et al. | 439/76.2 |

*Primary Examiner*—Khiem Nguyen
*Attorney, Agent, or Firm*—Patrick M. Griffin

[57] ABSTRACT

An electrical distribution center assembly and a method of constructing the same which eliminates the need to flip an electrical distribution center over in order to couple a wire harness connector to the electrical distribution center. The electrical distribution center assembly includes an electrical distribution center, a wire harness connector, and a connector retainer carried by a vehicle for temporarily holding the wire harness connector in position while the wire harness connector is coupled to the electrical distribution center.

24 Claims, 7 Drawing Sheets

TOP DOWN ELECTRICAL DISTRIBUTION CENTER ASSEMBLY

This is a continuation-in-part of U.S. Ser. No. 08/871,038 filed Jun. 9, 1997 now U.S. Pat. No. 5,788,529.

FIELD OF THE INVENTION

This invention generally relates to electrical distribution center assemblies, and more particularly to an electrical distribution center/wire harness sub-assembly/connector retainer combination and a method of assembling the same.

BACKGROUND OF THE INVENTION

Electrical distribution centers are being widely used in automobiles. The electrical distribution center is simply a central junction box or block system designed as a stand-alone assembly. This junction block can package various fuses, relays and other electrical devices in a central location. The electrical distribution centers not only reduce costs by consolidating these various functions into one block, but the centers also reduce the number of cut and spliced leads which helps to increase reliability. Such electrical distribution centers include provisions for electrically connecting a power source and electrical devices housed in the junction block to electrical wiring harness connectors for supplying power and control signals to various electrical systems of the vehicle such as air conditioning system; fuel supply systems; lighting circuit; instrument panels and to provide signals to engine and auxiliary systems such as anti-lock brake wiring assemblies.

Brussalis et al "Electrical Distribution Center With Two-piece Insulation Assembly" U.S. Ser. No. 08/689,619 (Attorney docket number H-182282) the disclosure of which is hereby incorporated by reference, describes an electrical power distribution center having features similar to the present invention. Such an electrical distribution center typically includes an upper and lower housing and a cover which fit together and are molded from a thermoplastic electrically insulative material. The lower housing includes a main body portion having a plurality of slots formed therethrough each for receiving the blade of a male terminal. A shroud extends from the edges of the main body portion and defines connector sockets in a bottom face of the lower housing, for receiving electrical connectors of a wire harness used in a vehicle application. The electrical center also includes a power bus which is carried in an insulation assembly. Additional electrical circuits may be carried in or on the insulation assembly. Male terminal blades extend out of the bottom face of the insulation assembly and through the slots in the lower housing for engagement with female terminals carried in the wire harness connector. However, when the number of terminals carried by the wire harness connector results in an engagement force greater than 80 Newtons, the engagement force is too great for an assembler to manually couple the wire harness connector to the male terminal blades and a mechanical assist, such as a bolt and nut, is necessary.

Heretofore, driving a bolt to couple the connector to the electrical center had not been an easy task. The electrical distribution center is housed in a splash shield overlying a shock tower and a wheel well of a vehicle. Consequently, in order to provide enough room to drive the bolt into the electrical distribution center with an electrical or pneumatic wrench, the center had to be flipped up side down so that the bottom face of the lower housing and the connector sockets were facing up towards the assembler and away from the splash shield. To accomplish this an additional length of wire harness was provided beyond that required to seat the center in its final position in the splash shield. Despite these additional length of wire harness, this process still required the assembler to pull on and sometimes twist the wire harness as the center was flipped over. This subjected the wire harness to possible damage. After the electrical distribution center and connector had been bolted together, the center was flipped back over right side up and placed down into the splash shield. The additional wire was stuffed down into the splash shield as best each assembler could. This process subjected the wire harness to possible bends and kinks or cuts, as well as creating a difficult operation in routing multiple wire harnesses and seating the electrical distribution center simultaneously.

The present invention provides alternatives to and advantages over the prior art.

SUMMARY OF THE INVENTION

The invention includes an electrical distribution center assembly and a method of constructing the same which eliminates the need to flip an electrical distribution center over in order to couple a wire harness connector to the electrical distribution center. The electrical distribution center assembly includes an electrical distribution center, a wire harness connector, and a connector retainer carried by a vehicle for temporarily holding the wire harness connector in position while the wire harness connector is coupled to the electrical distribution center. Typically, there are multiple wire harness connectors that mate with one electrical distribution center.

In one embodiment of the invention, the electrical distribution center assembly also includes a splash shield sub-assembly having a splash shield that carries the connector retainer. The splash shield may include a slot with an open end formed in a wall for receiving and guiding wire harness bundles.

In another embodiment of the invention, the connector retainer includes a plurality of bays, each bay for receiving a wire harness sub-assembly. The connector retainer temporarily holds the wire harness connector in position so that a bolt or other fastening device may be used to couple the electrical distribution center to the connector. The connector retainer may include alignment features mateable with alignment features on the wire harness sub-assembly for guiding the wire harness sub-assembly and preventing the same from cocking during the connector coupling process.

In another embodiment of the invention, the wire harness subassembly may be received directly into the bay of the connector retainer carried by the vehicle. Preferably the wire harness sub-assembly includes a wire dressing cover coupled to the connector. The wire dress cover may include a slot with an open end for collecting and guiding a wire harness bundle.

These and other objects, features, and advantages of the present invention will be apparent from the following brief description of the drawings, detailed description, and appended claims and drawings.

DETAILED DESCRIPTION

Figure 3:
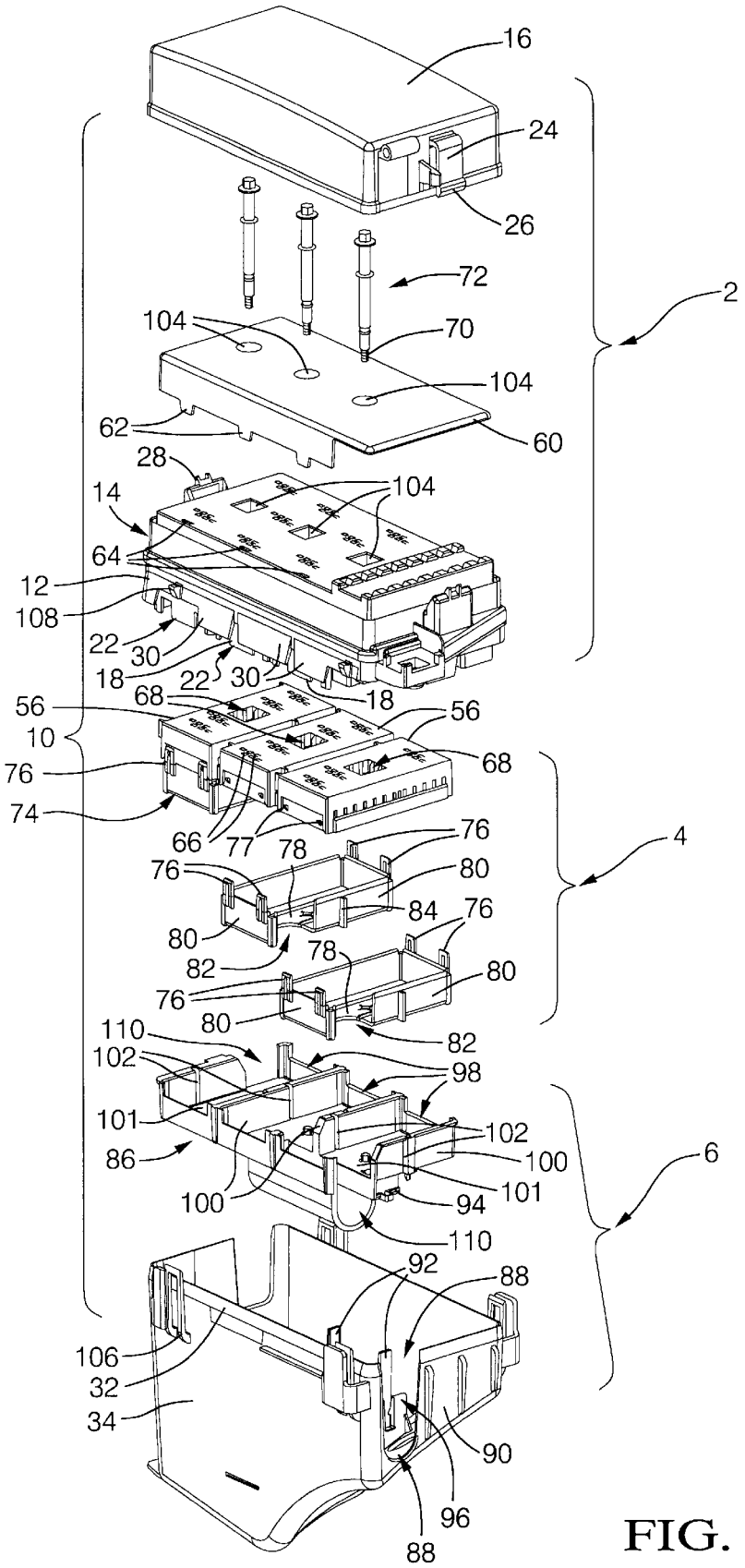
FIG. 3 is an exploded view of an electrical distribution center assembly according to the present invention.

As shown in FIG. 3, an electrical distribution center assembly 10 according to the present invention may include an electrical distribution center sub-assembly 2, a wire harness sub-assembly 4, and a splash shield sub-assembly 6. Details of these sub-assemblies 2, 4, 6 and their method of assembly will now be described.

Figure 1:
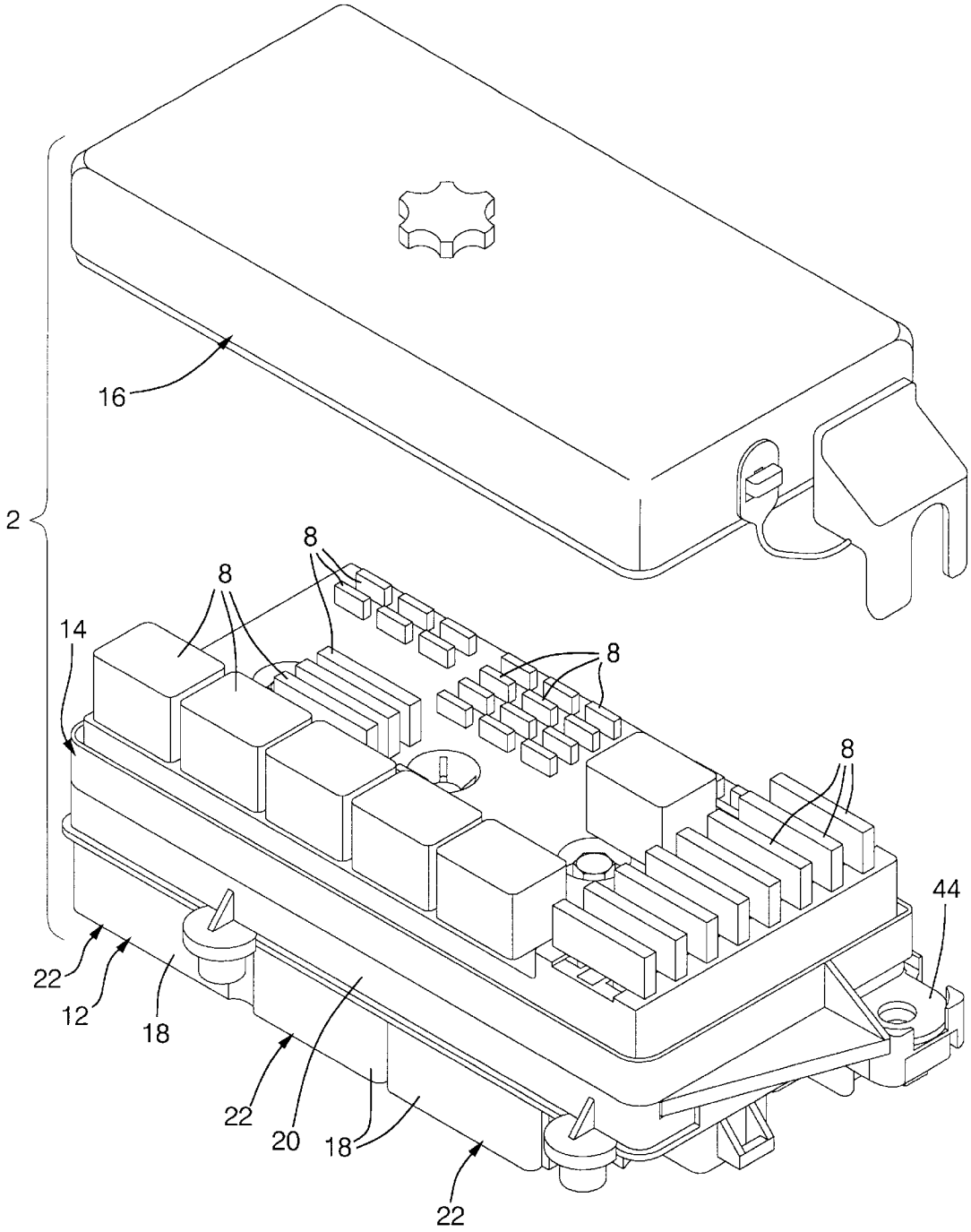
FIG. 1 is an illustration of a conventional electrical distribution center with a top cover removed.
Figure 2:
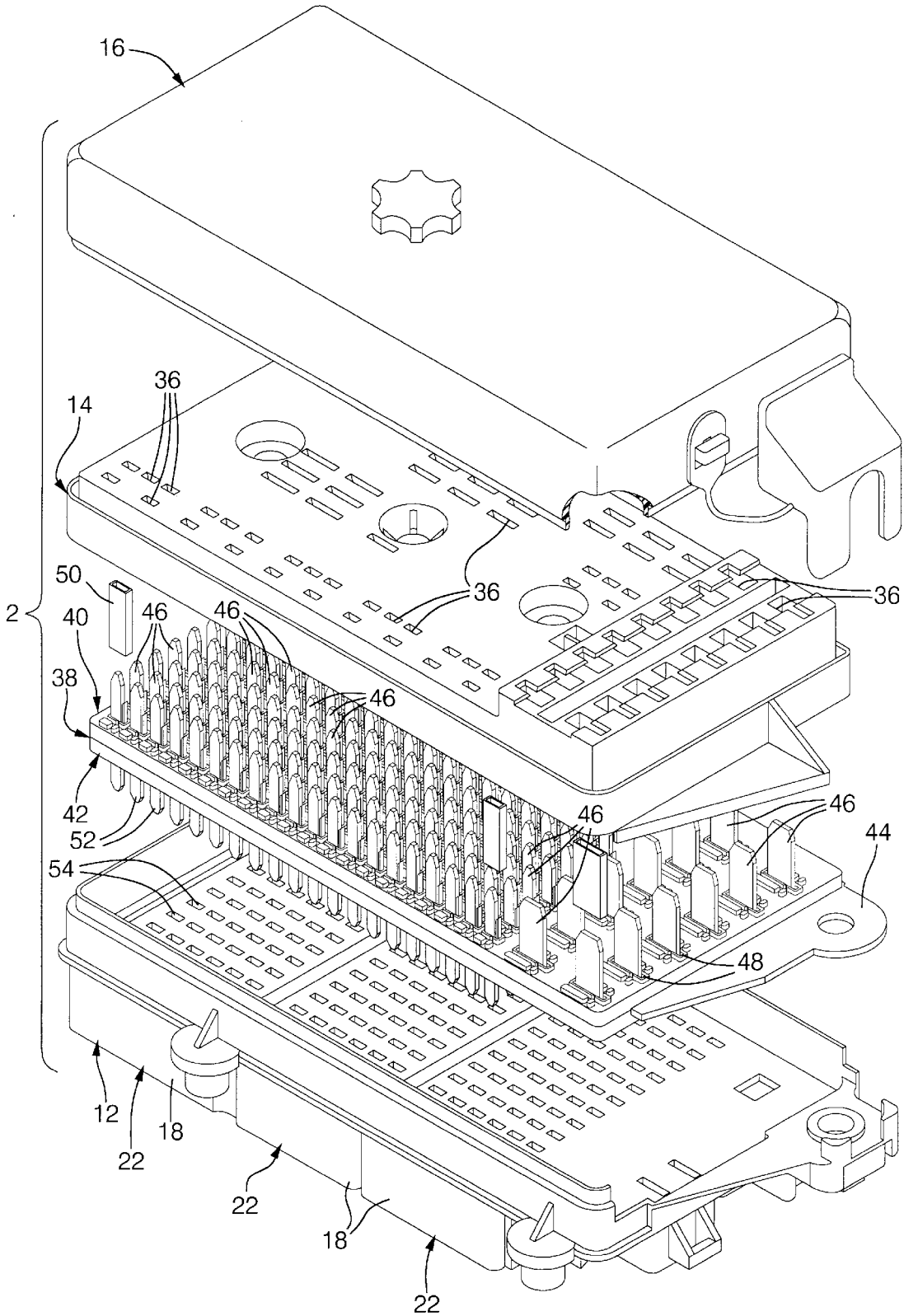
FIG. 2 is an exploded view of a conventional electrical distribution center.

FIGS. 1–3 illustrate various features of electrical distribution centers useful in the present invention. Referring to FIG. 1, an electrical distribution center 2 typically includes an upper and lower housing 14, 12 and a cover 16 that may be molded from a thermoplastic electrically insulative material. The lower housing 12 includes a shroud 18 extending downward from a body portion 20 to partially define connector sockets 22 for receiving electrical connectors 56 of a wire harness utilized in a vehicle application. The body portion 20 including the portion defining connector sockets 22 may be molded as an integral part of the lower housing. FIG. 3 illustrates an electrical distribution center similar to that in FIG. 1 and wherein the cover 16 may include a flexible lock arm 24 with a shoulder 26 at a free end to be engaged by a lock pawl 28 extending upwardly from the upper housing 14. A skirt 30 may extend outwardly from a side wall of the lower housing 12 for alignment to a sealing lip 32 on a top surface of a splash shield 34 described hereafter.

Referring to FIG. 1, the electrical distribution center includes several components that may be disposed between or on the upper and lower housings 14, 12. Mini-fuses, maxi-fuses, relays or other electrical devices 8 (FIG. 1) can be plugged into terminal cavities 36 (FIG. 2) in the upper housing 14. As shown in FIG. 2, a two-piece main insulation assembly 38 having upper and lower halves 40, 42 may be disposed between the upper and lower housings 14, 12. A main stamped metal buss plate 44 may be carried within the main insulation assembly 38 as well as a plurality of other stamped metal circuit components 46, such as male to male terminals or tuning fork terminals, which may be press fit into upper and lower halves 40, 42 of the main insulation assembly in a predetermined pattern. The main insulation assembly may also be insert molded. These stamped terminals 46 may be made as a part of the main metal buss plate and bent up or downward to protrude through slots 48 formed in either of the insulation assembly halves 40, 42. Alternatively, the metal buss plate 44 may include a flat planar body portion that is carried in a gap between the upper and lower insulation halves 40, 42 for interconnecting a plurality of metal terminals 46 that are perpendicularly attached or stitched through slots formed in the buss plate 44 or along edges of the buss plate. A female-to-female adapter 50 may be provided to make connection between a male terminal blade 46, extending upwardly from the upper insulation half 40, and the male blades (not shown) of a mini-fuses, maxi-fuses, relay or other electrical devices 8 extending through the upper housing 14. A plurality of male blades 52 extend downwardly from the lower insulation assembly half 42 through the slots 54 in the lower housing for engagement with female terminals carried in a connector 56 (FIG. 3) for the wire harness bundle 58 (illustrated in FIG. 4).

Figure 4:
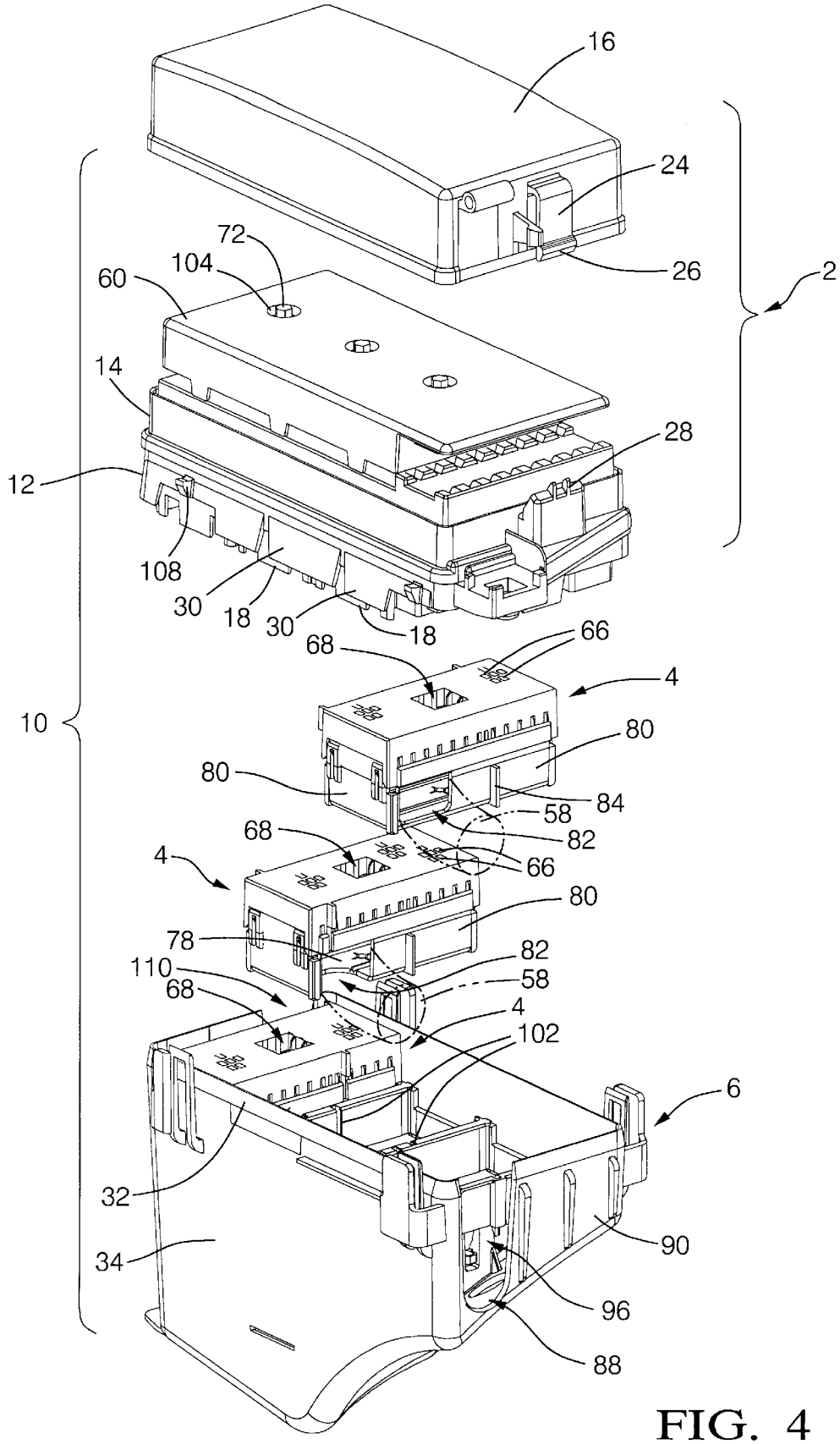
FIGS. 4–7 illustrate steps in a method of making an electrical distribution center assembly according to the present invention.

An electrical device shield 60 or cover, as shown in FIGS. 3 and 4, may be attached to the upper housing 14 to protect the maxi-fuses, mini-fuses, relays and other electrical devices 8 (FIG. 1) during shipment of the electrical distribution center. The electrical device shield 60 may include downwardly extending feet 62 that rest on the top face of an upper housing 14 with the device shield locking over the bolt heads 72. An electrical distribution center sub-assembly 2 as described above may be provided to the vehicle assembler with the top cover 16 removed.

Referring again to FIGS. 3 and 4, a wire harness sub-assembly 4 may be provided including a bundle of wires 58. Each wire includes a terminal (not shown) at one end and received in a cavity 66 in a connector body 56. The terminal is preferably a female terminal constructed and arranged for receiving a male blade 52 (FIG. 2) or other mateable component extending from the lower insulation half 42 of the electrical distribution center 2. A threaded bore 68 is provided through the wire harness connector body 56 for receiving the threaded end 70 of a bolt 72. The threaded bore 68 may be formed in the plastic connector body, or Alternatively, a threaded metal nut may be received in a passage extending through the connector body in a manner known to those skilled in the art.

A wire dressing cover 74 is provided and secured by a plurality of slotted flexible lock fingers 76 each for receiving a lock nub 77 on the wire harness connector body 56. The wire dressing cover 74 includes a base 78 with four upright walls 80. The base 78 and/or one of the walls 80 may have a slot 82 formed therein to collect, control and guide the wire harness bundle 58 in a predetermined direction. Guide rails 84 are provided on the outer surface of opposed walls 80 of the wire dressing cover and mate with slots in the connector retainer 86 to guide the wire harness sub-assembly 4 into the electrical distribution sub-assembly 2 in a manner to be described hereafter.

A splash shield sub-assembly 6 is provided including a connector retainer 86 and a splash shield 34. The splash shield 34 serves to prevent water and other materials from entering the electrical distribution center and to mount the BEC to the vehicle. A sealing lip 32 may be provided on the top surface of a splash shield wall and received under the skirt 30 on the lower housing 12 to properly align the electrical distribution center with respect to the splash shield and a connector retainer 86. At least one slot 88 with an open end may be provided in a wall 90 of the splash shield to receive and guide the wire harness bundles 58. The splash shield 34 has multiple ribs 92 formed along the inside walls thereof for supporting a connector retainer 86. The connector retainer 86 is snap fit into the splash shield by mating locking features 94 on the connector retainer and lock shoulder 96 of the splash shield. A plurality of bays 98 are defined in the connector retainer by two pairs of opposed walls 100 and a base 101. Guide grooves 102 are provided in the inside face of opposed walls 100 of the connector retainer 86 for receiving the guide rails 84 of the wire dressing cover 74. A slot 110 may be provided in the base 101 and /or walls 100 for guiding a wire harness bundle 58. An alternative to a splash shield sub-assembly is to mold the features of the splash shield and connector retainer as one part.

Figure 5:
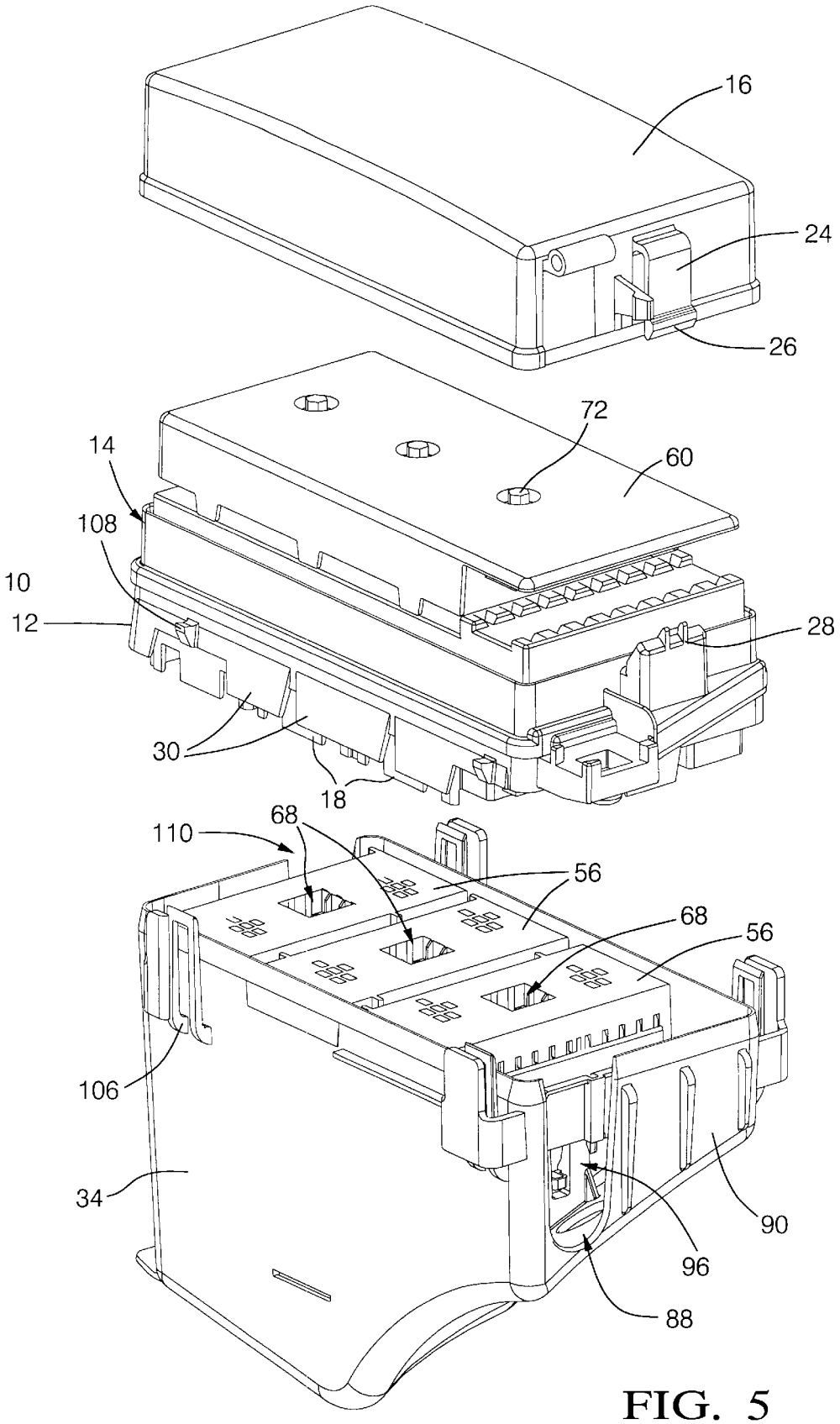
Figure 6:
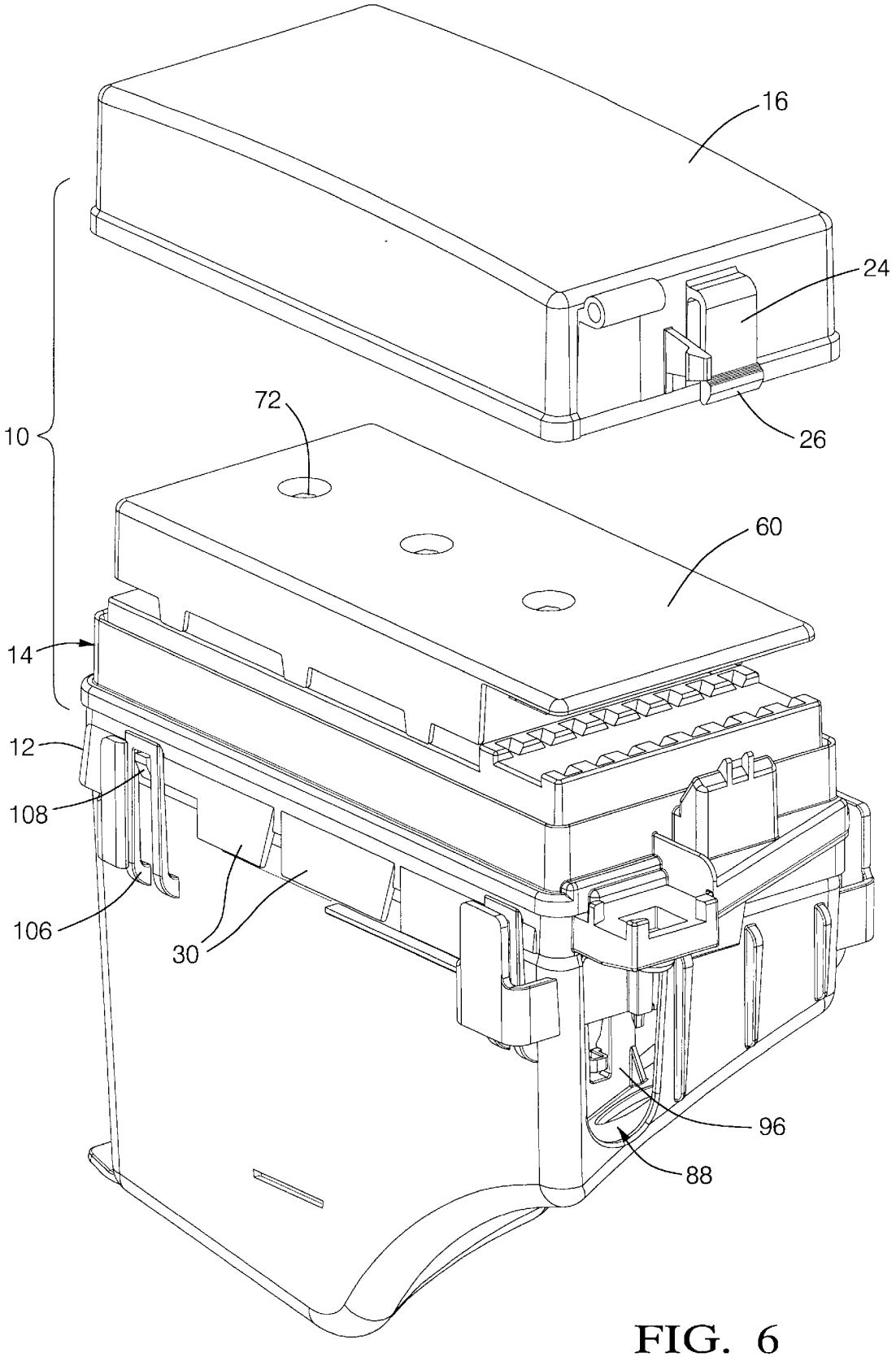
Figure 7:
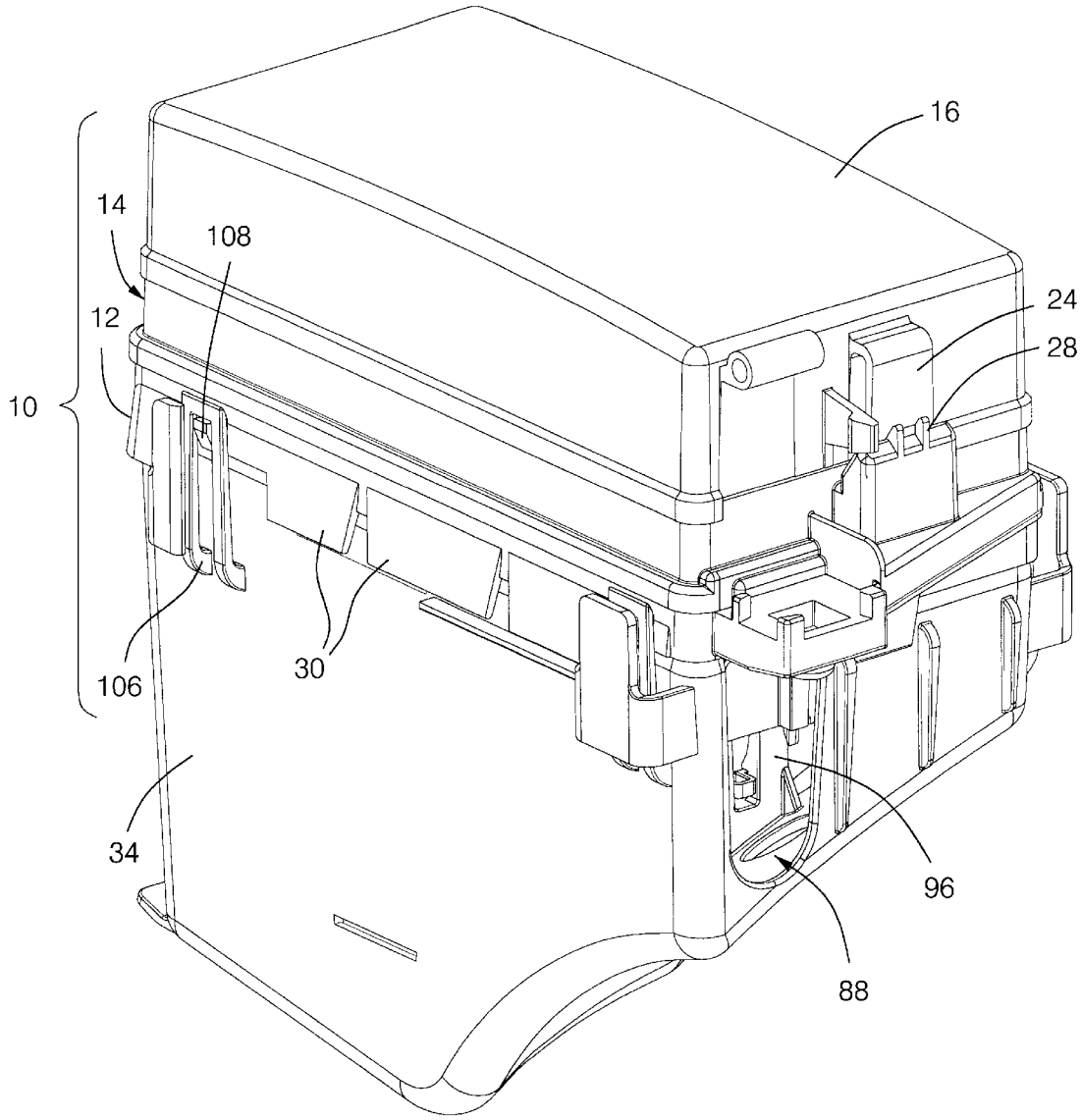

Referring to FIGS. 4–7, an electrical distribution center assembly may be constructed as follows. With the electrical distribution center sub-assembly 2, wire harness sub-assembly 4, and the splash shield sub-assembly 6 already constructed and with the splash shield sub-assembly mounted to the vehicle, a vehicle assembler places the wire harness sub-assembly(s) 4 down into the splash shield assembly 6 so that the guide rails 84 of the wire dressing cover are received in the guide grooves 102 of the connector retainer 86 (FIGS. 4–5). These guide rails 84 also serve as indexes to ensure that each wire harness assembly 4 can only be placed in the appropriate bay of the connector retainer and in the proper orientation such that they are aligned and positioned for blind mate. The electrical distribution center sub-assembly 2 is placed down into the splash shield sub-assembly 6 so that the sealing lip 32 on the splash shield 34 is captured and aligned by the skirt 30 on the electrical center lower housing 12 and so that the connector sockets 22 receive at least a portion of the wire harness sub-assembly 4. Complete alignment is achieved when slotted flexible lock fingers 106 extending from the splash shield receive the lock nubs 108 on the lower housing 12. The bolt 72 is preassembled through each of the passages 104 in the electrical distribution center so that the threaded end 70 enters the threaded bore 68 in the wire harness connector when the electrical distribution center locks down on the splash shield sub-assembly. Each bolt 72 is torqued (turned) so that the wire harness sub-assembly 4 is pulled up towards the electrical distribution center so that the connector 56 and associated terminals fully engage the male blades 52 (FIG. 2) extending from the lower housing 12. The guide rails 84 on the wire dressing cover 74 prevent the wire harness sub-assembly 4 from cocking as the bolt is driven to cause the connector 56 to move upward and engage the male blades 52 (FIG. 2) of the electrical distribution center. A cover 16 may be placed over the electrical distribution center to complete the assembly (FIG. 7). The assembly process can be performed in reverse order such that by driving the bolts backwards, the wire harness sub-assembly (s) 4 are driven downward until they reseat themselves into the connector retainer 86, and the electrical distribution center can be removed without harnesses being attached. This allows for servicing with a repeatable assembly and disassembly process.

Unlike the conventional assembly method, the electrical distribution center assembly of the present invention and the above described process is designed such that the wire harnesses are not attached to the electrical distribution center during the installation of the electrical distribution center onto the splash shield. This simplifies installation by separating the operations of routing conduit out of the splash shield and of aligning the electrical distribution center to the splash shield. This arrangement also eases handling of the electrical distribution center by eliminating the need to flip the electrical distribution center over with attached harnesses that pull on the electrical distribution center often in different directions. Consequently, a substantial amount of wire harness length is eliminated with the present invention. Further, the wire harness bundles 58 are directed in a predetermined direction through slots 82, 110, and 88 in the wire dressing cover 74, connector retainer 86, and the splash shield 34 respectively, thus eliminating the potential for bends, kinks or cuts in the wire bundle 58 during the assembly.

What is claimed is:

1. In a vehicle, a combination comprising: an electrical distribution center, a wire harness sub-assembly, and a splash shield sub-assembly mounted on the vehicle, the electrical distribution center having a plurality of first terminals extending from a lower surface of the center and a passage extending through the center for receiving a bolt, the wire harness sub-assembly comprising of a wire harness bundle and a connector body and a wire dress cover coupled to the connector body, the wire harness bundle including a plurality of wires each having a second terminal connected at one end of the wire and mateable with one of the first terminals, the second terminal being received in a cavity of the connector body, the connector body having a threaded bore extending therethrough for receiving the threaded end of the bolt, the wire dress cover having alignment features and locks for mating to a connector retainer carried by the splash sub-assembly for temporarily supporting the wire harness sub-assembly and to facilitate the coupling of the wire harness sub-assembly connector body to the electrical distribution center by the bolt without requiring the electrical distribution center to be flipped over.

2. A combination as set forth in claim 1 wherein the wire dress cover has a slot formed therein for collecting and guiding the wire harness bundle in a predetermined direction.

3. A combination as set forth in claim 1 wherein the connector retainer is an integral part of the splash shield.

4. A combination as set forth in claim 1 wherein the electrical distribution center includes an upper and lower housing, the lower housing having a plurality of connector sockets defined in a lower face, each socket for receiving a wire harness sub-assembly.

5. A combination as set forth in claim 1 wherein the connector retainer includes a bay defined in part by two pairs of opposed walls, and further comprising alignment and indexing features on at least one pair of the opposed walls mateable with alignment and indexing features on the wire harness sub-assembly to prevent the wire harness sub-assembly from cocking as the wire harness sub-assembly is bolted to the electrical distribution center.

6. A combination as set forth in claim 5 wherein the alignment features of the wire harness sub-assembly are on the wire dressing cover.

7. A combination as set forth in claim 1 wherein the splash shield includes alignment features mateable with alignment features on the electrical distribution center for properly aligning the electrical distribution center with the splash shield and connector retainer.

8. A combination as set forth in claim 1 wherein the splash shield includes a slot with an open end for collecting and guiding a wire harness bundle in a predetermined direction.

9. A combination as set forth in claim 1 wherein the electrical distribution center includes a main buss plate captured by an insulation assembly and a plurality of terminals extending through the insulation assembly.

10. A combination as set forth in claim 9 wherein a plurality of the terminals include a male blade extending downwardly and through the lower housing to be engaged by the wire harness sub-assembly connector.

11. A method of assembling an electrical distribution center assembly in a vehicle comprising:

mounting a splash shield sub-assembly having a connector retainer in the vehicle, providing an electrical distribution center and a wire harness subassembly wherein the wire harness sub-assembly comprises a wire bundle including a plurality of wires each having a terminal secured to an end, the terminal being received in a cavity formed in a connector body; the connector body having a threaded bore extending therethrough, and wherein the electrical distribution center includes a connector socket defined in a lower face thereof for receiving the connector body and a plurality of male blades extending through the lower face of the electrical distribution center, the electrical distribution center further including a passage extending therethrough for receiving a bolt;

placing the wire harness sub-assembly into the connector retainer; and placing a bolt through the passage in the electrical distribution center and into the threaded bore and driving the bolt so that the connector body is pulled out of the connector retainer and fully coupled to the make blades extending the lower face of the electrical center.

12. A method as set forth in claim 11 wherein the wire harness sub-assembly further comprises a wire dressing cover coupled to the connector body, the wire dressing cover having a slot formed therein for collecting and guiding the wire harness bundle in a predetermined direction.

13. A method as set forth in claim 11 wherein the connector retainer is an integral part of the splash shield.

14. A method as set forth in claim 11 wherein the electrical distribution center includes an upper and lower housing, the lower housing having a plurality of connector sockets defined in a lower face, each socket for receiving a wire harness sub-assembly.

15. A method as set forth in claim 11 wherein the connector retainer having a bay defined in part by two pairs of opposed walls, and further comprising alignment features on at least one pair of the opposed walls mateable with alignment and indexing features on the wire harness sub-assembly to prevent the wire harness sub-assembly from cocking as the wire harness sub-assembly is bolted to the electrical distribution center.

16. A method as set forth in claim 15 wherein the alignment features of the wire harness sub-assembly are on the wire dressing cover.

17. A method as set forth in claim 13 wherein the splash shield includes alignment features mateable with alignment features on the electrical distribution center for properly aligning the electrical distribution center with the splash shield and connector retainer.

18. A method as set forth in claim 13 wherein the splash shield includes a slot with an open end for collecting and guiding a wire harness bundle in a predetermined direction.

19. A method as set forth in claim 11 wherein the electrical distribution center includes a main buss plate captured by an insulation assembly and a plurality of terminals extending through the insulation assembly.

20. A method as set forth in claim 19 wherein a plurality of the terminals include a male blade extending downwardly and through the lower housing to be engaged by the wire harness sub-assembly connector.

21. A method of assembling an electrical distribution center assembly in a vehicle comprising:

mounting a splash shield sub-assembly having a connector retainer in the vehicle, providing an electrical distribution center and wherein the wire harness subassembly comprises a wire bundle including a plurality of wires each having a first terminal secured to an end, the first terminal being received in a cavity formed in a connector body; the connector body having a first fastening member, and wherein the electrical distribution center includes a connector socket defined in a lower face thereof for receiving the connector body and a plurality of second terminals extending through the lower face of the electrical distribution center further including a passage extending therethrough for receiving a second fastening member mateable with the first fastening member;

placing a wire harness sub-assembly into the connector retainer; and placing a second fastening member through the passage in the electrical distribution center and securing the first fastening member to the second fastening member so that the connector body is pulled out of the connector retainer and coupled to the mating terminals extending the lower face of the electrical center.

22. A method as set forth in claim 21 wherein connector retainer includes a slot formed therein for guiding a wire harness bundle in a predetermined direction.

23. A combination as set forth in claim 1 wherein connector retainer includes a slot formed therein for guiding a wire harness bundle in a predetermined direction.

24. A method as set forth in claim 11 wherein connector retainer includes a slot formed therein for guiding a wire harness bundle in a predetermined direction.

* * * * *